US008053990B2

(12) United States Patent
Bewlay et al.

(10) Patent No.: US 8,053,990 B2
(45) Date of Patent: Nov. 8, 2011

(54) HIGH INTENSITY DISCHARGE LAMP HAVING COMPOSITE LEG

(75) Inventors: Bernard Patrick Bewlay, Schenectady, NY (US); Bruce Alan Knudsen, Amsterdam, NY (US); Mohamed Rahmane, Clifton Park, NY (US); James Scott Vartuli, Rexford, NY (US); James Anthony Brewer, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 719 days.

(21) Appl. No.: 11/858,745

(22) Filed: Sep. 20, 2007

(65) Prior Publication Data

US 2009/0079346 A1 Mar. 26, 2009

(51) Int. Cl.
*H01J 17/00* (2006.01)
*H01J 61/36* (2006.01)

(52) U.S. Cl. ..... 313/623; 313/567; 313/608; 313/634; 313/624; 313/625

(58) Field of Classification Search ..... None
See application file for complete search history.

(56) References Cited

U.S. PATENT DOCUMENTS

| | | | | |
|---|---|---|---|---|
| 5,552,670 | A | 9/1996 | Heider et al. | |
| 6,066,918 | A | 5/2000 | Suzuki et al. | |
| 6,239,405 | B1 * | 5/2001 | Jones et al. | 219/121.63 |
| 6,657,388 | B2 | 12/2003 | Wijenberg et al. | |
| 7,498,742 | B2 * | 3/2009 | Janssen et al. | 313/567 |
| 7,615,929 | B2 * | 11/2009 | Bewlay et al. | 313/625 |
| 2002/0117965 | A1 | 8/2002 | Kotter et al. | |
| 2002/0145388 | A1 | 10/2002 | Kelly et al. | |
| 2003/0209984 | A1 | 11/2003 | Niimi | |
| 2004/0119413 | A1 | 6/2004 | Kebbede et al. | |
| 2004/0119414 | A1 | 6/2004 | Bewlay et al. | |
| 2004/0135510 | A1 | 7/2004 | Bewlay et al. | |
| 2006/0008754 | A1 | 1/2006 | Janssen et al. | |
| 2006/0068679 | A1 * | 3/2006 | Bewlay et al. | 445/26 |
| 2006/0222878 | A1 | 10/2006 | Watanabe et al. | |
| 2007/0018582 | A1 | 1/2007 | Tsuda et al. | |
| 2009/0167179 | A1 * | 7/2009 | Allen et al. | 313/623 |
| 2009/0224674 | A1 * | 9/2009 | Selezneva et al. | 313/623 |
| 2010/0033093 | A1 * | 2/2010 | Leonard et al. | 313/623 |

FOREIGN PATENT DOCUMENTS

EP 1253616 10/2002

* cited by examiner

*Primary Examiner* — Natalie Walford
(74) *Attorney, Agent, or Firm* — Fletcher Yoder

(57) ABSTRACT

A system, in certain embodiments, includes a high intensity discharge lamp having a composite leg. The composite leg includes a plurality of leg sections coupled together in series. The plurality of leg sections includes different materials, coefficients of thermal expansion, Poisson's ratios, or elastic moduli, or a combination thereof. A method, in certain embodiments, includes enclosing a high intensity discharge within a ceramic arc envelope. The method also includes reducing thermal stresses associated with the high intensity discharge via a composite leg extending outwardly from the ceramic arc envelope. The composite leg includes a plurality of leg sections coupled together in series. The plurality of leg sections includes different materials, coefficients of thermal expansion, Poisson's ratios, or elastic moduli, or a combination thereof.

28 Claims, 4 Drawing Sheets

HIGH INTENSITY DISCHARGE LAMP HAVING COMPOSITE LEG

BACKGROUND

The invention relates generally to lamps and, more particularly, techniques to reduce the potential for thermal stresses and cracking in high intensity discharge (HID) lamps.

High-intensity discharge lamps are often formed from a ceramic tubular body or arc tube that is sealed to one or more end structures. Unfortunately, various stresses may arise from the sealing process, the interface between the joined components, and the materials used for the different components. For example, the component materials may have different mechanical and physical properties, such as different coefficients of thermal expansion (CTE), which can lead to residual stresses and sealing cracks. These potential stresses and sealing cracks are particularly problematic for high-pressure lamps.

HID lamps are typically assembled and dosed in a dry box, which includes a furnace to facilitate hot sealing with temperatures reaching about 1500 degrees centigrade or higher. Unfortunately, the dry box complicates the assembly of HID lamps due to the closed environment. In addition, the furnace typically subjects the dose materials to high temperatures, thereby limiting the operational pressure of the dose materials.

BRIEF DESCRIPTION

A system, in certain embodiments, includes a high intensity discharge lamp having a composite leg. The composite leg includes a plurality of leg sections coupled together in series. The plurality of leg sections includes different materials, coefficients of thermal expansion, Poisson's ratios, or elastic moduli, or a combination thereof. A method, in certain embodiments, includes enclosing a high intensity discharge within a ceramic arc envelope. The method also includes reducing thermal stresses associated with the high intensity discharge via a composite leg extending outwardly from the ceramic arc envelope. The composite leg includes a plurality of leg sections coupled together in series. The plurality of leg sections includes different materials, coefficients of thermal expansion, Poisson's ratios, or elastic moduli, or a combination thereof.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Figure 1:
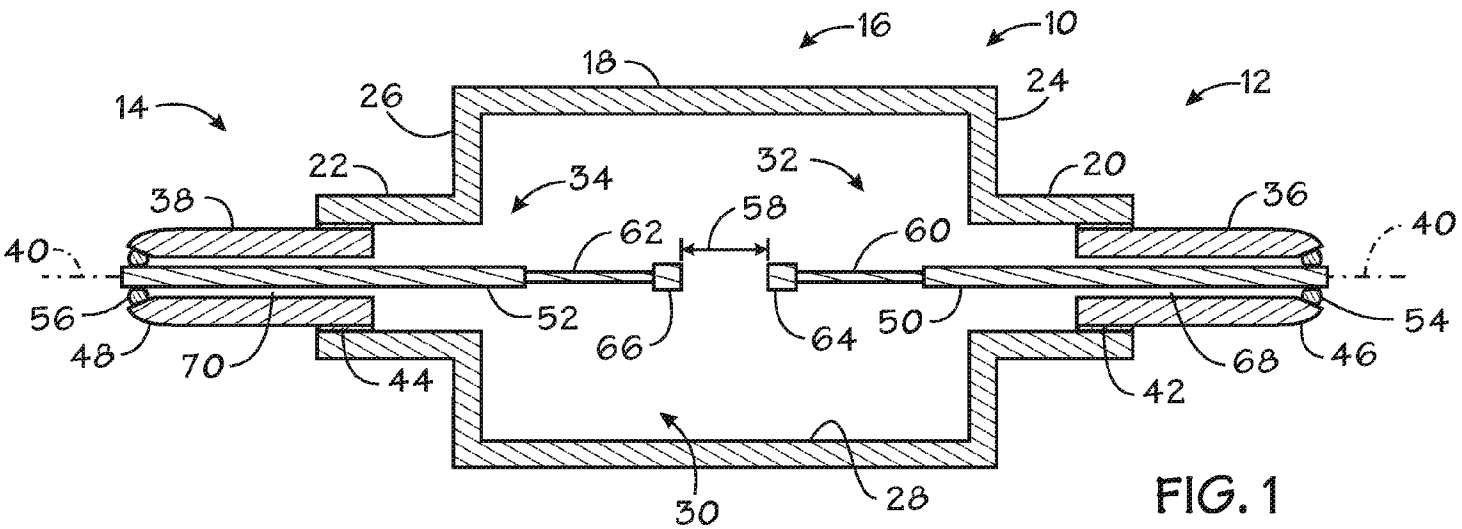
FIG. 1 is a cross-sectional view of an embodiment of a high intensity discharge lamp having composite legs with both ceramic and non-ceramic portions.

FIG. 1 is a cross-sectional view of a lamp 10 in accordance with certain embodiments of the present invention. As illustrated, the lamp 10 includes composite legs 12 and 14 (e.g., dosing tubes) having a plurality of different leg sections made of a plurality of different materials having characteristics or properties desirable for operation of the lamp 10. For example, the different materials may include a ceramic, a cermet, a metal, an alloy, or a combination thereof. The different characteristics or properties of these materials may include electrical conductivity, resistance to corrosive dosing materials, ductility, coefficient of thermal expansion (CTE), Poisson's ratio, elastic modulus, or a combination thereof. For example, the composite legs 12 and 14 may include a plurality of tubular sections (e.g., hollow cylindrical sections coupled together in series) made of different materials, wherein each section has certain desirable characteristics (e.g., corrosion resistant section, ductile section, electrically conductive section, etc.).

The composite legs 12 and 14 may simplify the manufacturing process, reduce the potential for thermal stresses, increase the pressure capacity, increase the light output, and/or enable use of a wide variety of dosing materials. For example, in certain embodiments, an assembly process includes dosing the lamp 10 and sealing the composite legs 12 and 14 at room temperature without a dry box and/or a furnace. As a result, the illustrated lamp 10 is amenable to dosing with mercury and a high cold (e.g., room temperature) pressure of a buffer gas, such as 10 atmospheres of xenon. The composite legs 12 and 14 also may include different materials having different coefficients of thermal expansion, which gradually change (e.g., in steps) from one section to another to reduce thermal stresses during start up, operation, and shut down of the lamp 10.

In addition, the composite legs 12 and 14 may have any number of sections and different materials to provide the desired characteristics to improve performance of the lamp 10. For example, the composite legs 12 and 14 may include 2, 3, 4, 5, 6, 7, 8, 9, 10, or more different sections and/or materials. These sections of the composite leg 12 and 14 may include tubular sections that are coaxial and at least partially overlapping one another. In addition, the various tubular sections of the composite legs 12 and 14 may include one or more intermediate compliant seals (e.g., annular seals). The compliant seals have properties that are generally between those of the sections coupled together by the compliant seals. In this manner, the compliant seal provides a more gradual change in the properties from one section to another. These properties may include coefficient of thermal expansion, Poisson's ratio, elastic modulus, or a combination thereof.

As discussed in detail below, in certain embodiments, the composite legs 12 and 14 include one or more ceramic tubular sections and one or more metallic tubular sections. The one or more metallic tubular sections may include molybdenum, rhenium, molybdenum-rhenium alloy, niobium, or a combination thereof. For example, in each discussion of this alloy below, an exemplary molybdenum-rhenium alloy has about 35-55% by weight of rhenium. In certain embodiments, the molybdenum-rhenium alloy comprises about 44-48% by weight of rhenium. The molybdenum and molybdenum-rhenium alloy materials are thermochemically compatible with corrosive dose materials, such as metal halides. Moreover, the molybdenum, rhenium, molybdenum-rhenium alloy, and niobium materials enable sealing at room temperature without a dry box and furnace. For example, these materials are sufficiently ductile to enable mechanical compression via a crimping tool. The niobium may also have certain advantageous characteristics, such as high electrical conductivity.

As illustrated in FIG. 1, the lamp 10 includes an arc envelope 16 having a central hollow body 18 with opposite leg sections 20 and 22. Embodiments of the arc envelope 16 are formed from a variety of transparent ceramics and other materials, such as yttrium-aluminum-garnet, ytterbium-aluminum-garnet, microgram polycrystalline alumina (μPCA), alumina or single crystal sapphire, yttria, spinel, and ytterbia. Other embodiments of the arc envelope 16 are formed from conventional lamp materials, such as polycrystalline alumina (PCA). However, the foregoing materials advantageously provide lower light scattering and other desired characteristics. Various embodiments of the arc envelope 16 also have different forms, such as a bulb, a cylinder, a semi-sphere, or any other suitable hollow body.

In the illustrated embodiment, the leg sections 20 and 22 are an integral part of the central hollow body 18. In other words, the hollow body 18 and leg sections 20 and 22 are a single or one-piece structure, which may be made from a suitable transparent ceramic. In alternative embodiments, the leg sections 20 and 22 are separate from the central hollow body 18, but are sealed at opposite end portions 24 and 26 of the hollow body 18. In such an embodiment, the leg sections 20 and 22 may be made of the same ceramic or a different ceramic than the hollow body 18. In the illustrated embodiment, the hollow body 18 and the leg sections 20 and 22 have a hollow tubular or cylindrical geometry, wherein the hollow body 18 has a diameter greater than the leg sections 20 and 22. The arc envelope 16 also defines an interior volume 28 to contain a dosing material 30 and electrode assemblies 32 and 34.

In certain embodiments, the lamp 10 may have a variety of different lamp configurations and types, such as a high intensity discharge (HID) or an ultra high intensity discharge (UHID) lamp. For example, certain embodiments of the lamp 10 comprise a high-pressure sodium (HPS) lamp, a ceramic metal halide (CMH) lamp, a short arc lamp, an ultra high pressure (UHP) lamp, or a projector lamp. Thus, the lamp 10 may be part of a video projector, a vehicle light, a vehicle, or a street light, among other things. As mentioned above, the lamp 10 is uniquely sealed to accommodate relatively extreme operating conditions. Externally, some embodiments of the lamp 10 are capable of operating in a vacuum, nitrogen, air, or various other gases and environments. Internally, some embodiments of the lamp 10 retain pressures exceeding 200, 300, or 400 bars and temperatures exceeding 1000, 1300, or 1400 degrees Kelvin. For example, certain configurations of the lamp 10 operate at internal pressure of 400 bars and an internal temperature at or above the dew point of mercury at 400 bars, i.e., approximately 1400 degrees Kelvin. These higher internal pressures are also particularly advantageous to short arc lamps, which are capable of producing a smaller (e.g., it gets smaller in all directions) arc as the internal lamp pressure increases. Different embodiments of the lamp 10 also hermetically retain the variety of dosing materials 30, such as a rare gas and mercury. In some embodiments, the dosing material 30 comprises a halide (e.g., bromine, iodine, etc.) or a rare earth metal halide. Certain embodiments of the dosing material also include a buffer gas, such as xenon gas.

The illustrated electrode assemblies 32 and 34 extend through and are supported by the composite legs 12 and 14. As illustrated in FIG. 1, the composite leg 12 includes the leg section 20 of the arc envelope 16 and an additional leg section 36. Similarly, the composite leg 14 includes the leg section 22 of the arc envelope 16 and an additional leg section 38. In the illustrated embodiment, the leg sections 20, 22, 36, and 38 are coaxial with one another along an axis 40 extending lengthwise through the central hollow body 18. In particular, the leg section 20 is coaxial with and overlaps an annular portion of the leg section 36. A compliant seal 42 fills an annular gap 68 between the leg section 20 and the leg section 36. Similarly, the leg section 22 is coaxial with and overlaps an annular portion of the leg section 38. Again, a compliant seal 44 fills an annular gap 70 between the leg section 22 and the leg section 38. In alternative embodiments, the leg sections 36 and 38 may be coaxial with and overlapping an outer annular portion of the corresponding leg sections 20 and 22. Moreover, other embodiments of the composite legs 12 and 14 may include additional leg sections that are coaxial with and overlapping one another in a series arrangement as discussed in further detail below.

The leg sections 20, 22, 36, and 38 of the composite legs 12 and 14 may include a variety of different materials with desirable characteristics for the lamp 10. For example, the leg sections 20 and 22 may be made of a ceramic, such as polycrystalline alumina (PCA), while the leg sections 36 and 38 may be made from a different ceramic, a non-ceramic material, a cermet, a metal, an alloy, or a combination thereof. For example, in one embodiment, the leg sections 36 and 38 may be made from molybdenum, or rhenium, or a molybdenum-rhenium alloy, or niobium, or a combination thereof. In the illustrated embodiment, the leg sections 36 and 38 are made from a metal or alloy that is both ductile and resistive to corrosive substances in the dosing material 30, for example, metal halides. Accordingly, the illustrated leg sections 36 and 38 of the embodiment of FIG. 1 are made of either molybdenum or a molybdenum-rhenium alloy. These materials are both ductile and resistive to metal halides. The compliant seals 42 and 44 may be any suitable sealing glass or material, such as dysprosia-alumina-silica, which has a coefficient of thermal expansion that is generally between that of the leg sections 20 and 22 and the leg sections 36 and 38.

In view of the ductility of the leg sections 36 and 38, the composite legs 12 and 14 are directly compressed and hermetically sealed about portions of the electrode assemblies 32 and 24. As illustrated, the leg sections 36 and 38 have compressed portions or crimps 46 and 48 disposed directly about lead wires 50 and 52 of the electrode assemblies 32 and 34. The illustrated leg sections 36 and 38 also include welds 54 and 56, such as laser welds, directly fusing the crimps 46 and 48 with the lead wires 50 and 52. These crimps 46 and 48 and associated welds 54 and 56 are performed without a dry box and/or a furnace. Therefore, the lamp 10 may be assembled, dosed, and sealed at room temperature without subjecting all of the components and the dosing material 30 to high heat associated with the furnace. As a result, the cold sealing (e.g., room temperature sealing) of the lamp 10 may enable substantially higher pressures of the dosing material 30, thereby improving light output and performance of the lamp 10. For example, the dosing material 30 may include mercury, a halide, and a buffer gas such as xenon. The composite legs 12 and 14 and unique seals provided by the compliant seals 42 and 44, the crimps 46 and 48, and the welds 54 and 56, may enable pressures as high as 10 atmospheres or even higher at room temperature. The high pressure capacity is particularly advantageous for certain buffer gases, such as xenon.

The electrode assemblies 32 and 34 along with the composite legs 12 and 14 enable precise control of an arc gap 58 to improve performance of the lamp 10. As illustrated, the electrode assemblies 32 and 34 and the composite legs 12 and 14 are all aligned lengthwise along and coaxial with the axis 40. During assembly, the electrode assemblies 32 and 34 can move along the axis 40 toward and away from one another to adjust the arc gap 58. Specifically, the electrode assemblies 32 and 34 include the lead wires 50 and 52, electrodes 60 and 62, and arc tips 64 and 66 separated from one another by the arc gap 58.

In certain embodiments, the assembly process includes moving the electrode assembly 32 lengthwise along the axis 40 within the leg section 36 until a desired position is reached within the hollow body 18. The process also may include compressing the ductile material of the leg section 36 directly about and engaging the lead wire 50 to create the crimp 46, which secures the position of the arc tip 64. The process also may include applying focused heat via a laser, an induction heating device, a welding torch, or another suitable focused heat source, to create the weld 54 between the leg section 36 and the lead wire 50. Thus, the composite leg 12 is completely sealed about the electrode assembly 32 in a room temperature environment prior to injecting the dose material 30.

Subsequently, in certain embodiments, the process may include inserting the electrode assembly 34 lengthwise along the axis 40 into the hollow body 18 through the composite leg 14. The process may include filling the arc envelope 16 with the dosing material 30 through the composite leg 14 via a processing station as discussed in further detail below. Again, the dosing material 30 is provided at room temperature without a dry box or furnace. Subsequently, the process may include compressing the leg section 38 directly about and engaging the lead wire 52 to create the crimp 48. The process may then proceed to apply focused heat to create the weld 56 directly fusing the leg section 38 to the lead wire 52. Advantageously, the process of crimping and applying focused heat does not significantly heat or shock the dosing material 30 within the arc envelope 16. Therefore, the process can result in a much greater pressure of the dosing materials 30, e.g., including a buffer gas such as xenon. In other embodiments, the process may include injecting the dosing material 30 through the composite leg 14 before insertion of the electrode assembly 34. Furthermore, the electrode assembly 34 is crimped and welded in place at a suitable position to set the desired arc gap 58 between the arc tips 64 and 66.

The illustrated electrode assemblies 32 and 34 of FIG. 1 include a plurality of sections made of different materials to improve performance and compatibility with surrounding components of the lamp 10. For example, the lead wires 50 and 52 may be made of molybdenum or a molybdenum-rhenium alloy, which may be the same or different than the material of the leg sections 36 and 38. In certain embodiments, the leg sections 36 and 38 and the lead wires 50 and 52 are all made of the same molybdenum-rhenium alloy or simply molybdenum. As a result, the leg sections 36 and 38 and the lead wires 50 and 52 may have identical or substantially similar characteristics (e.g., CTEs, Poisson's ratios, elastic moduli, etc.), thereby reducing the possibility of stress cracks forming at the welds 54 and 56. In the embodiment of FIG. 1, the electrodes 60 and 62 may be made from a different material from the lead wires 50 and 52. For example, the electrodes 60 and 62 may be made from a tungsten wire that is bonded or welded to the molybdenum or molybdenum-rhenium lead wires 50 and 52. In addition, the arc tips 64 and 66 may be made from tungsten, or molybdenum, or rhenium, or combinations thereof.

In addition, the lead wires 50 and 52 have outer diameters that are smaller than inner diameters of the leg sections 36 and 38, thereby forming intermediate annular gaps 68 and 70. These annular gaps 68 and 70 may enable some expansion and contraction of the leg sections 36 and 38 relative to the lead wires 50 and 52, thereby reducing the possibility of stress on the leg sections 36 and 38. However, in some embodiments, the outer diameter of the lead wires 50 and 52 may be more closely fitting within the leg sections 36 and 38.

Figure 2:
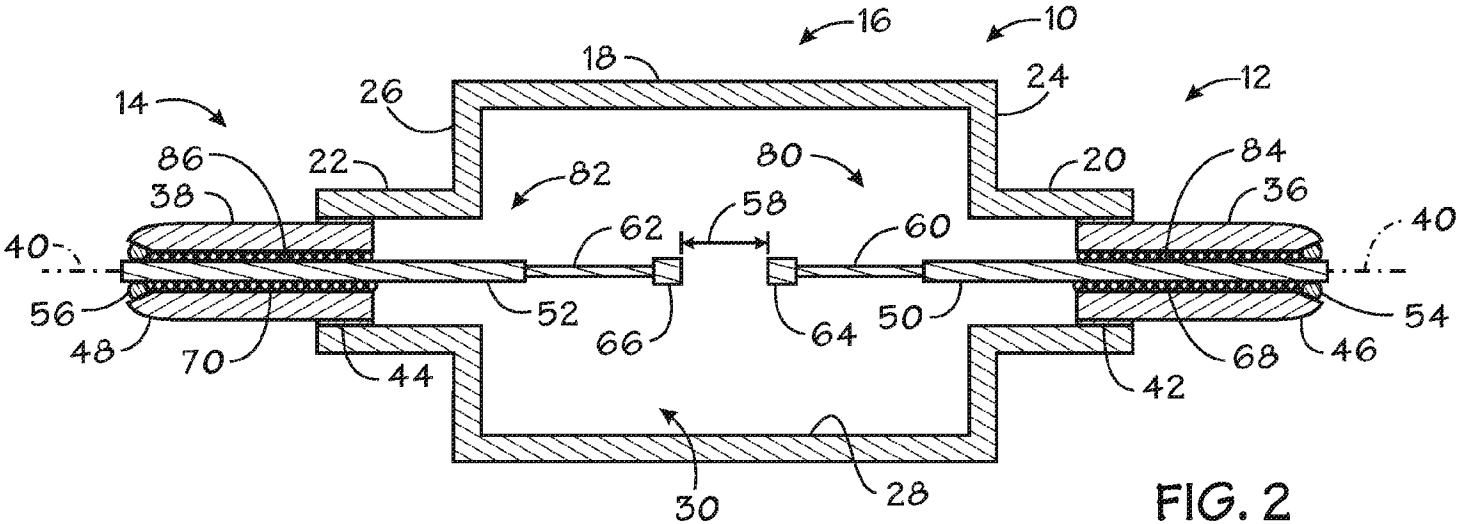
FIG. 2 is a cross-sectional view of an alternative embodiment of the high intensity discharge lamp as illustrated in FIG. 1, further illustrating a compressible lead assembly disposed in compressible portions of the composite legs.

FIG. 2 is a cross-sectional view of an alternative embodiment of the lamp as illustrated in FIG. 1, further illustrating electrode assemblies 80 and 82 with wire coils 84 and 86. The illustrated coils 84 and 86 are disposed in the annular gaps 68 and 70 between the lead wires 50 and 52 and the surrounding leg sections 36 and 38. In other words, the electrode assemblies 80 and 82 may be described as having the components of the electrode assemblies 32 and 34 of FIG. 1 along with the wire coils 84 and 86.

In the illustrated embodiment of FIG. 2, the wire coils 84 and 86 may facilitate both alignment and reduction of potential stresses between the lead wires 50 and 52 and the surrounding leg sections 36 and 38. For example, as the leg sections 36 and 38 expand and contract relative to the lead wires 50 and 52, the wire coils 84 and 86 may provide some flexibility or resiliency to accommodate this change in geometry. In addition, the wire coils 84 and 86 provide a substantially closer fit between the lead wires 50 and 52 and the surrounding leg sections 36 and 38 as compared to the embodiment of FIG. 1. The wire coils 84 and 86 also provide support along a greater length of the lead wires 50 and 52 within the leg sections 36 and 38, thereby providing greater stability and more accurate positioning of the arc tips 64 and 66 within the arc envelope 16. For example, in the illustrated embodiment, the wire coils 84 extend along a substantial portion or the full length of the leg sections 36 and 38 rather than limiting support to the crimps 46 and 48 and the welds 54 and 56 as illustrated in FIG. 1.

However, similar to the embodiment of FIG. 1, the electrode assemblies 80 and 82 of FIG. 2 are compressed within and welded to the leg sections 36 and 38 via the crimps 46 and 48 and the corresponding welds 54 and 56. Specifically, in the illustrated embodiment of FIG. 2, the leg sections 36 and 38 are compressed about the wire coils 84 and 86, which in turn compress onto the lead wires 50 and 52. The illustrated welds 54 and 56 fuse the materials of the leg sections 36 and 38, the lead wires 50 and 52, and the associated wire coils 84 and 86. In certain embodiments, the leg sections 36 and 38 of FIGS. 1 and 2 may be compressed or crimped at different locations or at multiple locations along the length of the leg sections 36 and 38.

In the embodiment of FIG. 2, the electrode assemblies 80 and 82 may be composed of a variety of materials similar to those described above with reference to FIG. 1. For example, the lead wires 50 and 52 may comprise a material composition including molybdenum, or rhenium, or a molybdenum-rhenium alloy, or a combination thereof. The electrodes 60 and 62 may have a material composition including tungsten or molybdenum, or rhenium, or combinations thereof. The arc tips 64 and 66 may have a material composition including tungsten, or molybdenum, or rhenium, or combinations thereof. The wire coils 84 may have a material composition including molybdenum, or rhenium, or molybdenum-rhenium alloy, or a combination thereof. In one embodiment, the lead wires 50 and 52 and the wire coils 84 and 86 are all made of molybdenum. In another embodiment, the lead wires 50 and 52 and the wire coils 84 and 86 are all made of a molybdenum-rhenium alloy. In these two embodiments, the leg sections 36 and 38 are also made of the same materials, e.g., molybdenum or a molybdenum-rhenium alloy. Thus, the leg sections 36 and 38, the lead wires 50 and 52, and the wire coils 84 and 86 have an identical or close match in properties (e.g., CTEs, Poisson's ratios, elastic moduli, etc.), thereby improving the seal and reducing the potential for stress cracks between these components.

Figure 3:
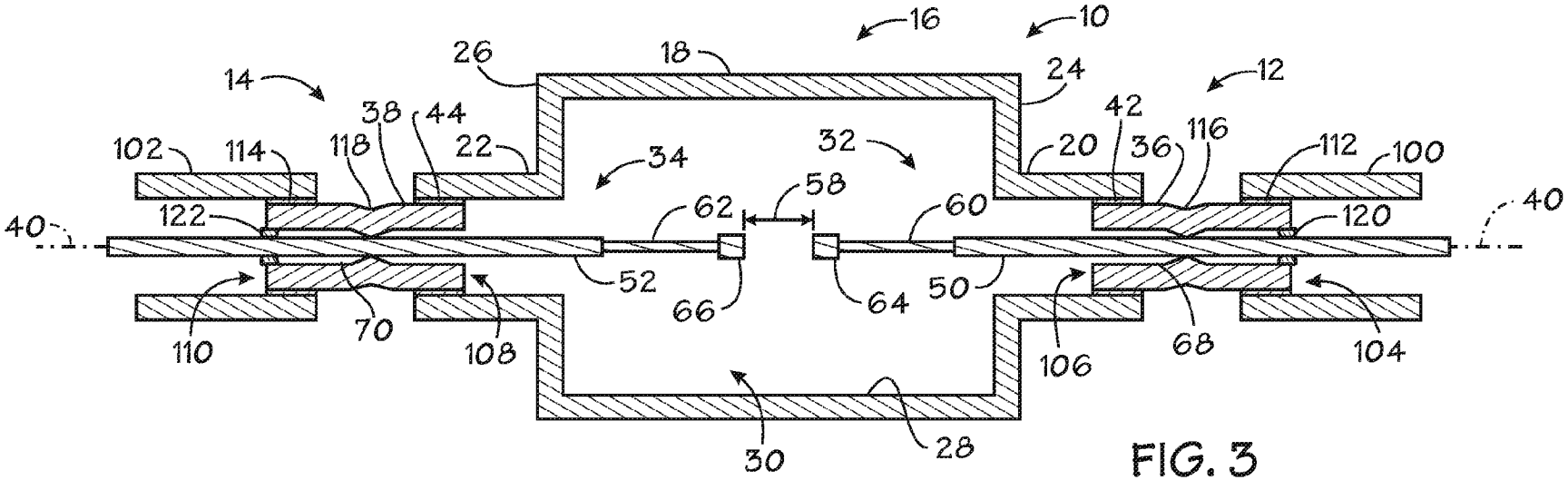
FIG. 3 is a cross-sectional view of an embodiment of a high intensity discharge lamp having composite legs with both ceramic and two different non-ceramic portions.

FIG. 3 is a cross-sectional view of an alternative embodiment of the lamp 10 as illustrated in FIG. 1, further illustrating the composite legs 12 and 14 with additional leg sections 100 and 102. Specifically, in the illustrated embodiment, the composite leg 12 includes the leg section 20 of the arc envelope 16, the leg section 36, and the leg section 100 disposed coaxial with one another in a series arrangement one after another. Similarly, the composite leg 14 includes the leg section 22 of the arc envelope 16, the leg section 38, and the leg section 102 disposed coaxial with one another in a series arrangement one after another. In the illustrated embodiment, the leg sections 36 and 38 have diameters that are smaller than the leg sections 20, 22, 100, and 102. In other words, the leg sections 20 and 100 are disposed concentrically about and overlapping opposite end portions 104 and 106 of the leg section 36. Similarly, the leg sections 22 and 102 are disposed concentrically about and overlapping opposite end portions 108 and 110 of the leg section 38.

Similar to the embodiment of FIG. 1, the leg sections 20 and 22 are coupled to the leg sections 36 and 38 via intermediate compliant seals 42 and 44. Again, the compliant seals 42 and 44 have properties (e.g., CTEs, Poisson's ratios, elastic moduli, etc.) intermediate those of the leg sections 36 and 38 and the surrounding leg sections 20 and 22. Similarly, compliant seals 112 and 114 are disposed between the leg sections 36 and 38 and the surrounding leg sections 100 and 102. These compliant seals 112 and 114 also have properties (e.g., CTEs, Poisson's ratios, elastic moduli, etc.) between those of the leg sections 36 and 38 and the surrounding leg sections 100 and 102. In the illustrated embodiment, the leg sections 36 and 38 also support, secure, and hermetically seal with the lead wires 50 and 52 of the lead assemblies 32 and 34, respectively. Similar to the embodiment of FIG. 1, the leg sections 36 and 38 are compressed about the lead wires 50 and 52 as indicated by crimps 116 and 118. The leg sections 36 and 38 are also fused to the lead wires 50 and 52 via laser welding, induction heating, or another spot welding or focused heating technique as indicated by welds 120 and 122.

In the embodiment of FIG. 3, the leg sections 20 and 22, the leg sections 36 and 38, and the leg sections 100 and 102 may have material compositions that are the same or different from one another. For example, the leg sections 20 and 22 may be made of a transparent ceramic, such as polycrystalline alumina (PCA). The leg sections 36, 38, 100, and 102 may be made of a material composition including a metal, an alloy, a cermet, or a combination thereof. For example, the leg sections 36 and 38 may be made of a ductile, electrically conductive material, such as molybdenum, or rhenium, or niobium, or a molybdenum-rhenium alloy, or a combination thereof. The leg sections 100 and 102 may be made of a material composition including molybdenum, or rhenium, or niobium, or a molybdenum-rhenium alloy, or a combination thereof.

In one embodiment, the leg sections 36, 38, 100, and 102 are all made of niobium. In another embodiment, the leg sections 36, 38, 100, and 102 are all made of molybdenum or a molybdenum-rhenium alloy. In a further embodiment, the leg sections 36 and 38 are both made of molybdenum or a molybdenum-rhenium alloy, while the leg sections 100 and 102 are both made of niobium. In another embodiment, the leg sections 36 and 38 are both made of a molybdenum-rhenium alloy, while the leg sections 100 and 102 are both made of molybdenum, or a different molybdenum-rhenium alloy, or a different metallic composition, or a cermet. Similar to the embodiment of FIG. 1, the compliant seals 42, 44, 112, and 114 may be made of one or more annular layers of materials having different properties (e.g., CTEs, Poisson's ratios, elastic moduli, etc.) to reduce the gradients in those properties between the different leg sections 20, 22, 36, 38, 100, and 102.

The assembly process for the lamp 10 of FIG. 3 is similar to the assembly process of FIG. 1 with the exception of the leg sections 100 and 102. For example, in certain embodiments, the assembly process may include inserting the leg sections 36 and 38 into the leg sections 20 and 22, and subsequently sealing the sections together via the compliant seals 42 and 44. For example, the assembly process may include heating the compliant seals 42 and 44 in a furnace without all of the other components and without the dosing material 30. Alternatively, the assembly process may include applying focused heat via a laser, induction heating, or another suitable focused heating device without using a dry box and/or a furnace. At this point, the assembly process may include heating the compliant seals 112 and 114 to couple the leg sections 36 and 38 to the leg sections 100 and 102. Again, the heating process may include a variety of focused heating techniques, such as laser welding, induction heating, spot welding, and so forth. Alternatively, the assembly of the arc envelope 16 with the leg sections 20 and 22, the leg sections 36 and 38, the leg sections 100 and 102, and the compliant seals 42, 44, 112, and 114 may be disposed simultaneously into a furnace to seal the components together.

Continuing with the assembly process, the lead assemblies 32 and 34 may be secured to the composite legs 12 and 14 either before or after sealing the leg sections 100 and 102 to the leg sections 36 and 38. In either case, the leg sections 36 and 38 may be compressed about and welded to the lead wires 50 and 52 as indicated by crimps 116 and 118 and welds 120 and 122. However, one of the legs 36 or 38 is not sealed shut about the respective lead wire 50 or 52 until the dosing material 30 is injected into the arc envelope 16. For example, the assembly process may include crimping and welding the leg section 36 about the lead wire 50, injecting the dosing material 30 into the arc envelope 16 through the open leg section 38, and then subsequently crimping and welding the leg section 38 about the lead wire 52. In this manner, the dosing material 30 is not subjected to the heat associated with a furnace. Furthermore, the focused heat applied to the leg section 38 and the lead wire 52 to create the weld 122 does not substantially increase the temperature of the dosing material 30 within the arc envelope 16.

In certain embodiments, the assembly process also cools or freezes the dosing material 30 and/or the lamp 10 as the dosing material 30 is injected into the arc envelope 16. For example, liquid nitrogen may be used to substantially cool the arc envelope 16 and the composite leg 12. Again, as discussed above with reference to FIG. 1, the cold sealing or room temperature sealing techniques (e.g., crimping and laser welding) along with cooling (e.g., cooling with liquid nitrogen) eliminates many complexities and problems associated with use of a dry box and a furnace, while also improving the performance of the lamp. For example, these techniques can provide much greater pressures of the dosing material 30 disposed within the lamp 10. By further example, the room temperature pressure of the dosing materials 30 may be 10 atmospheres or greater. As a result, a buffer gas such as xenon can be effectively used at high pressures within the lamp 10.

Figure 4:
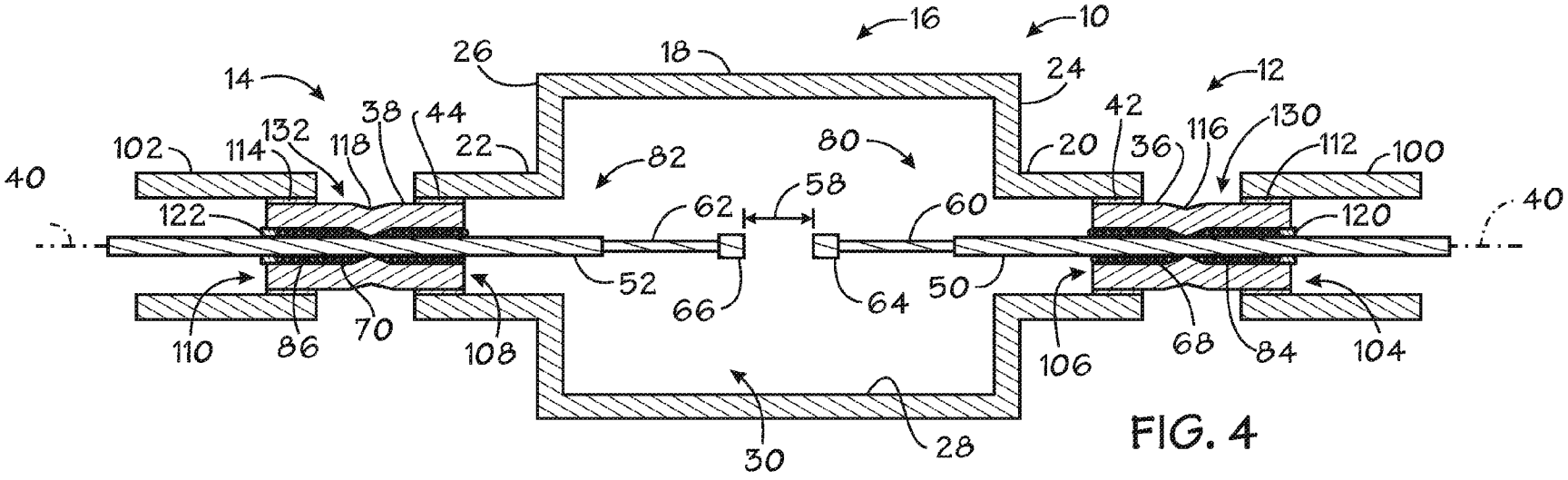
FIG. 4 is a cross-sectional view of an alternative embodiment of the high intensity discharge lamp as illustrated in FIG. 3, further illustrating a compressible lead assembly disposed in compressible portions of the composite legs.

FIG. 4 is a cross-sectional view of an alternative embodiment of the lamp 10 as illustrated in FIG. 3. Specifically, the lamp 10 of FIG. 4 has substantially the same features of FIG. 3 with the additional wire coils 84 and 86 as illustrated in FIG. 2. In other words, the lamp 10 of FIG. 4 has the electrode assemblies 80 and 82 as illustrated in FIG. 2 rather than the electrode assemblies 32 and 34 as illustrated in FIGS. 1 and 3. As illustrated in FIG. 4, the wire coils 84 and 86 are disposed in the annular gaps 68 and 70 between the lead wires 50 and 52 and the surrounding leg sections 36 and 38. The crimps 116 and 118 are disposed at intermediate portions 130 and 132 of the leg sections 36 and 38 rather than the end portions 104 and 110 as shown in the embodiment of FIGS. 1 and 2. As indicated by crimps 116 and 118, the leg sections 36 and 38 compress against the wire coils 84 and 86, which in turn compress against the lead wires 50 and 52 to secure the axial position of the lead assemblies 80 and 82. In addition, the welds 120 and 122 fuse the materials of the leg sections 36 and 38, the wire coils 84 and 86, and the lead wires 50 and 52. Similar to the embodiment of FIG. 2, the wire coils 84 and 86 provide support, stability, alignment, and flexibility of the lead assemblies 80 and 82 along a substantial portion or the entire length of the leg sections 36 and 38. The flexibility or resiliency of the wire coils 84 and 86 enables the leg sections 36 and 38 to expand and contract in response to changes in temperature without causing significant stress between the components.

Figure 5:
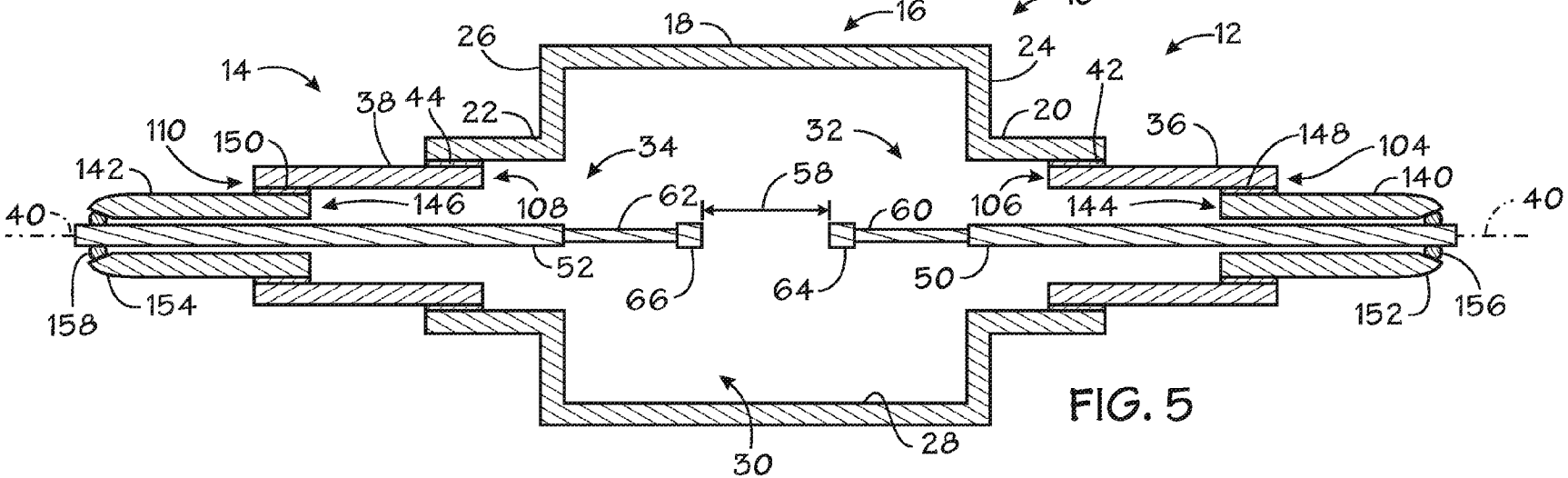
FIG. 5 is a cross-sectional view of another embodiment of a high intensity discharge lamp having composite legs with both ceramic and two different non-ceramic portions.

FIG. 5 is a cross-sectional view of another alternative embodiment of the lamp 10 as illustrated in FIG. 1, further illustrating an embodiment of the composite legs 12 and 14 with additional leg sections 140 and 142. Specifically, the illustrated leg sections 140 and 142 are disposed coaxial and in a series arrangement with the leg sections 20 and 22 and the leg sections 36 and 38. In the illustrated embodiment, the leg sections 20 and 22 are disposed concentrically about and overlap end portions 106 and 108 of the leg sections 36 and 38. The leg sections 20 and 22 are hermetically sealed with the leg sections 36 and 38 via compliant seals 42 and 44. In turn, the end portions 104 and 110 of the leg sections 36 and 38 are disposed concentrically about and overlap end portions 144 and 146 of the leg sections 140 and 142. The leg sections 36 and 38 are hermetically sealed with the leg sections 140 and 142 via compliant seals 148 and 150. The leg sections 140 and 142 are compressed about and welded to the lead wires 50 and 52 as indicated by crimps 152 and 154 and welds 156 and 158.

As discussed above with reference to FIG. 3, the compliant seals 42, 44, 148, and 150 may be heated simultaneously via a furnace or sequentially via focused heat to create hermetical seals between the leg sections 20, 22, 36, 38, 140, and 142. In some embodiments, the crimps 152 and 154 and the welds 156 and 158 may be performed after creating the compliant seals 42, 44, 148, and 150. In other embodiments, the crimps 152 and 154 and the welds 156 and 158 may be created prior to the compliant seals 148 and 150 but after the compliant seals 42 and 44. For example, the crimps 152 and 154 and the welds 156 and 158 may be formed at the opposite inner ends (e.g., end portions 144 and 146) of the leg sections 140 and 142 to protect the material of the leg sections 140 and 142 from corrosive substances in the dosing materials 30 disposed within the arc envelope 16.

The leg sections 20 and 22, the leg sections 36 and 38, and the leg sections 140 and 142 may be made of the same or different materials such as a ceramic, a metal, an alloy, a cermet, or a combination thereof. In certain embodiments, the leg sections 20 and 22 are made of a transparent ceramic as part of the arc envelope 16. The leg sections 140 and 142 may be made of a ductile and/or electrically conductive material, such as a metal, an alloy, or a combination thereof. In some embodiments, the leg sections 140 and 142 are made of molybdenum, or rhenium, or a molybdenum-rhenium alloy, or niobium, or a combination thereof. The material of the leg sections 140 and 142 may be selected to provide good electrical conductivity while also enabling compression to form the crimps 152 and 154.

In one embodiment, the leg sections 140 and 142 are made of niobium, which has good electrical conductivity but poor resistance to corrosive materials such as a metal halide in the dosing material 30. Accordingly, in embodiments using niobium for the leg sections 140 and 142, the welds 156 and 158 may be located at the end portions 144 and 146 of the leg sections 140 and 142 as discussed above. In addition, protective layers may be disposed at the end portions 144 and 146 and/or along the interior of the leg sections 140 and 142. These protective coatings or layers may include molybdenum, or molybdenum-rhenium, or another suitable material resistant to attack by halides and other corrosive materials in the dosing material 30.

In addition, the leg sections 36 and 38 may be made with materials having properties (e.g., CTEs, Poisson's ratios, elastic moduli, etc.) between those of the leg sections 20 and 22 and the leg sections 140 and 142. In this manner, the composite legs 12 and 14 may have a gradual change in properties (e.g., CTEs, Poisson's ratios, elastic moduli, etc.), which may further reduce the possibility of thermal stresses arising within the legs 12 and 14. Furthermore, the compliant seals 42, 44, 148, and 150 may be selected with properties (e.g., CTEs, Poisson's ratios, elastic moduli, etc.) between the surrounding leg sections. As a result, the composite legs 12 and 14 may have a plurality (e.g., 2, 3, 4, 5, 6, 7, 8, 9, 10, or more) of different materials or properties (e.g., CTEs, Poisson's ratios, elastic moduli, etc.) associated with the leg sections 20 and 22, the compliant seals 42 and 44, the leg sections 36 and 38, the compliant seals 148 and 150, and the leg sections 140 and 142. Furthermore, some embodiments of the compliant seals 42, 44, 148, and 150 may include a plurality of concentric layers of different materials with different properties (e.g., CTEs, Poisson's ratios, elastic moduli, etc.), thereby further reducing the gradients between adjacent leg sections.

In the illustrated embodiment, the leg sections 36 and 38 may be formed of a cermet, a metal, an alloy, or a combination thereof. For example, in one embodiment, the leg sections 36 and 38 are made of molybdenum, rhenium, a molybdenum-rhenium alloy, niobium, or a combination thereof. In one embodiment, the leg sections 20 and 22 are made of a transparent ceramic such as PCA, the leg sections 36 and 38 are made of a molybdenum-rhenium alloy, and the leg sections 140 and 142 are made of niobium. In addition, the electrode assemblies 32 and 34 may have a variety of material compositions as discussed in detail above.

Figure 6:
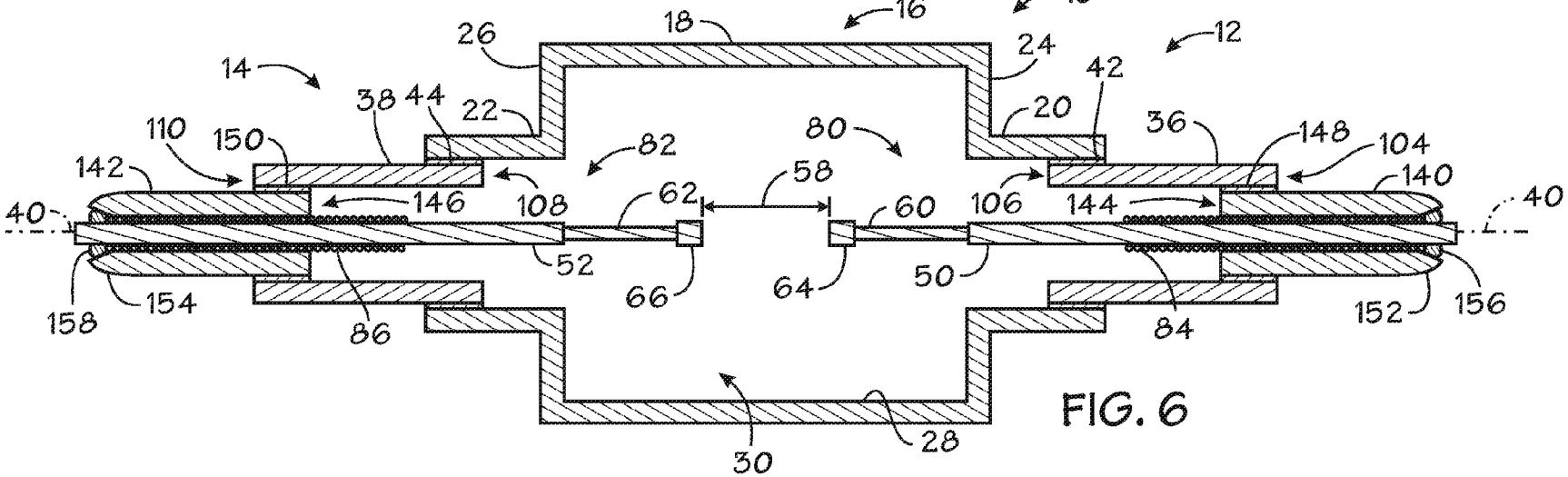
FIG. 6 is a cross-sectional view of an alternative embodiment of the high intensity discharge lamp as illustrated in FIG. 5, further illustrating a compressible lead assembly disposed in compressible portions of the composite legs.

FIG. 6 is a cross-sectional view of an alternative embodiment of the lamp 10 as illustrated in FIG. 5. In the embodiment of FIG. 6, the lamp 10 has substantially the same features as shown in FIG. 5 with the additional wire coils 84 and 86 as shown in the embodiments of FIGS. 2 and 4. Accordingly, the lamp 10 of FIG. 6 includes the electrode assemblies 80 and 82 as shown in FIGS. 2 and 4 rather than the electrode assemblies 32 and 24 as shown in FIGS. 1, 3, and 5. In the illustrated embodiment of FIG. 6, the leg sections 140 and 142 are compressed about and welded to the lead wires 50 and 52 and the wire coils 84 and 86 as indicated by the crimps 152 and 154 and the welds 156 and 158. Again, the wire coils 84 and 86 provide additional support, stability, and flexibility for the lead wires 50 and 52 within the leg sections 140 and 142. Accordingly, as the leg sections 140 and 142 expand and contract, the wire coils 84 and 86 provide some play or ability to accommodate thermal stresses to reduce the possibility of stress cracks developing in the composite legs 12 and 14.

Figure 7:
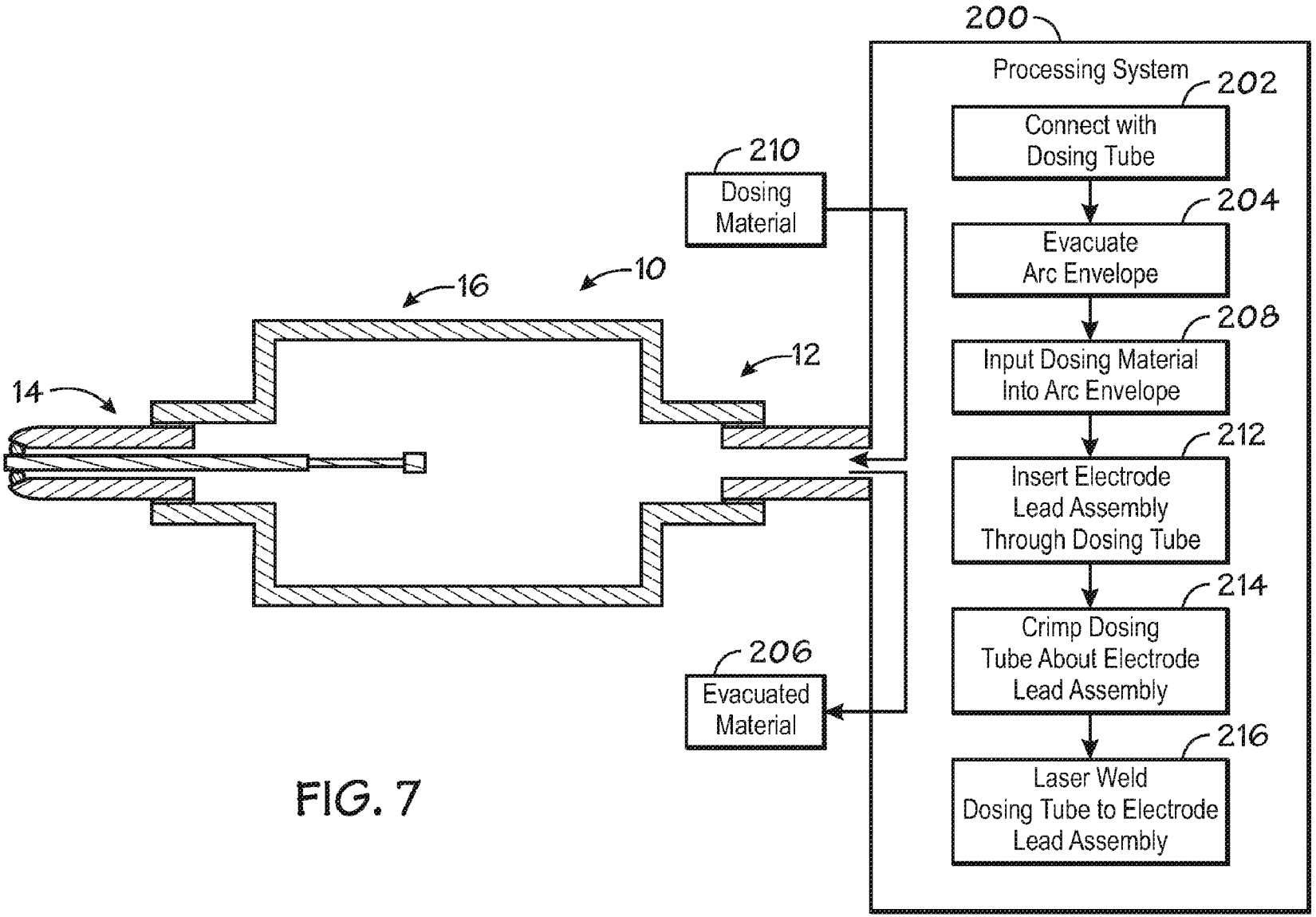
FIG. 7 is diagram illustrating an embodiment of a system for evacuating and dosing the high intensity discharge lamps as illustrated in FIGS. 1-6.

FIG. 7 is a diagram illustrating an exemplary processing system 200 coupled to the lamp 10 as illustrated in FIG. 1. Again, as discussed in detail above, the lamp 10 is assembled, sealed, and dosed without the use of a dry box or furnace. In the illustrated embodiment of FIG. 7, the composite leg 12 is coupled to the processing system 200 as indicated by block 202. The processing system 200 is configured to evacuate the arc envelope 16 through the composite leg 12 as indicated by blocks 204 and 206. The processing system 200 is also configured to input a dosing material into the arc envelope 16 through the composite leg 12 as indicated by blocks 208 and 210. The processing system 200 is also configured to enable insertion of the electrode assembly 32 through the composite leg 12 as indicated by block 212. The processing system 200 also enables the composite leg 12 to be crimped about the electrode assembly 32 as indicated by block 214. Finally, the processing system 200 enables the composite leg 12 to be laser welded to the electrode assembly 32 as indicated by block 216. FIG. 1 illustrates the lamp 10 after performing steps 202 through 216. Again, as discussed above, the processing system 200 enables the lamp 10 to be filled with the dosing material at room temperature without the need for a dry box or furnace. In this manner, the lamp 10 can be filled with dosing materials at a much higher pressure, for example, greater than 10 atmospheres. Moreover, the lamp 10 can be filled with high pressure buffer gases, such as xenon gas.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a high intensity discharge lamp comprising an arc envelope having a central hollow body coupled to a composite leg, wherein the composite leg comprises an axially staggered tube assembly, comprising:

a first tube extending axially away from the central hollow body, wherein the first tube comprises a ceramic material;

a second tube coupled to the first tube along a first annular interface, wherein the second tube extends axially away from the first tube, and the second tube comprises molybdenum, or rhenium, or a molybdenum-rhenium alloy; and a third tube coupled to the second tube along a second annular interface axially offset from the first annular interface, wherein the third tube extends axially away from the second tube; and an electrode assembly comprising a lead extending through the composite leg, wherein the second tube is compressively secured about the lead.

2. The system of claim 1, wherein the arc envelope is a one-piece structure having both the central hollow body and the first tube made of the ceramic material.

3. The system of claim 2, wherein the first tube has a smaller diameter than the central hollow body.

4. The system of claim 1, wherein the first tube comprises a first axial length, the second tube comprises a second axial length, and the first and second tubes only partially overlap along a first portion of the first axial length and a second portion of the second axial length to form the first annular interface.

5. The system of claim 4, wherein the third tube comprises a third axial length, and the second and third tubes only partially overlap along a third portion of the second axial length and a fourth portion of the third axial length to form the second annular interface.

6. The system of claim 1, wherein the third tube comprises a metallic material.

7. The system of claim 6, wherein the metallic material comprises niobium.

8. The system of claim 1, wherein the lead comprises molybdenum, or rhenium, or a molybdenum-rhenium alloy.

9. A system, comprising:

a lamp, comprising:

a ceramic arc envelope comprising a central hollow body;

a first composite leg extending outwardly from the central hollow body, wherein the first composite leg comprises a first axially staggered tube assembly, comprising:

a first tube having a first end portion coupled to the central hollow body, wherein the first tube extends in a first axial direction away from the first end portion along a first tube distance to a first opposite end portion;

a second tube having a second end portion coupled to the first opposite end portion of the first tube, wherein the second tube extends in the first axial direction away from the first opposite end portion along a second tube distance to a second opposite end portion; and a third tube having a third end portion coupled to the second opposite end portion of the second tube, wherein the third tube extends in the first axial direction away from the second opposite end portion along a third tube distance to a third opposite end portion, the third end portion of the third tube is axially offset from the first opposite end portion of the first tube in the first axial direction, and the first, second, and third tubes comprise different materials, coefficients of thermal expansion, Poisson's ratios, or elastic moduli, or a combination thereof; and a first electrode assembly comprising a first lead, a first electrode coupled to the first lead, and a first arc tip coupled to the first electrode, wherein the first lead extends through the first composite leg, the first arc tip is positioned within the central hollow body, and the first composite leg is coupled to the first lead.

10. The system of claim 9, wherein the first tube is made of a ceramic and the second tube is made of molybdenum, or rhenium, or a molybdenum-rhenium alloy.

11. The system of claim 9, wherein the first tube is made of a ceramic and the second tube is made of niobium.

12. The system of claim 9, wherein at least one of the first, second, or third tubes is made of molybdenum, or rhenium, or a molybdenum-rhenium alloy, wherein at least one of the first, second, or third tubes is made of a ceramic.

13. The system of claim 9, wherein the first tube is made of a ceramic, the second tube is made of molybdenum, or rhenium, or a molybdenum-rhenium alloy, and the third tube is made of niobium.

14. The system of claim 9, wherein the first tube is made of a ceramic, the second tube is made of niobium, and the third tube is made of niobium.

15. The system of claim 9, comprising:

a second composite leg extending outwardly from the central hollow body, wherein the second composite leg comprises a second axially staggered tube assembly, comprising:

a fourth tube having a fourth end portion coupled to the central hollow body, wherein the fourth tube extends in a second axial direction away from the fourth end portion along a fourth tube distance to a fourth opposite end portion, and the first and second axial directions are opposite from one another;

a fifth tube having a fifth end portion coupled to the fourth opposite end portion of the fourth tube, wherein the fifth tube extends in the second axial direction away from the fourth opposite end portion along a fifth tube distance to a fifth opposite end portion; and a sixth tube having a sixth end portion coupled to the fifth opposite end portion of the fifth tube, wherein the sixth tube extends in the second axial direction away from the fifth opposite end portion along a sixth tube distance to a sixth opposite end portion, the sixth end portion of the sixth tube is axially offset from the fourth opposite end portion of the fourth tube, and the fourth, fifth, and sixth tubes comprise different materials, coefficients of thermal expansion, Poisson's ratios, or elastic moduli, or a combination thereof; and a second electrode assembly comprising a second lead, a second electrode coupled to the second lead, and a second arc tip coupled to the second electrode, wherein the second lead extends through the second composite leg, the second arc tip is positioned within the central hollow body at an arc gap from the first arc tip, and the second composite leg is coupled to the second lead.

16. The system of claim 9, comprising a dosing material disposed within the ceramic arc envelope, wherein the dosing material comprises mercury, halide, and xenon.

17. A method, comprising:

providing a composite leg for a high intensity discharge lamp, wherein the composite leg comprises an axially staggered tube assembly, comprising:

a first metal tube that extends in a first axial direction from a first end portion along a first tube distance to a first opposite end portion, wherein the first metal tube is made of niobium, or molybdenum, or rhenium, or a molybdenum-rhenium alloy;

a second metal tube having a second end portion coupled to the first opposite end portion of the first metal tube, wherein the second metal tube extends in the first axial direction away from the first opposite end portion along a second tube distance to a second opposite end portion, the second metal tube is made of niobium; and providing a wire coil through the composite leg, wherein the wire coil is made of molybdenum, or rhenium, or a molybdenum-rhenium alloy.

18. A method, comprising:

enclosing a high intensity discharge within a ceramic arc envelope; and reducing thermal stresses associated with the high intensity discharge via a composite leg extending outwardly from a central hollow body of the ceramic arc envelope, wherein the composite leg comprises an axially staggered tube assembly, comprising:

a first tube having a first end portion coupled to the central hollow body, wherein the first tube extends in a first axial direction away from the first end portion along a first tube distance to a first opposite end portion;

a second tube having a second end portion coupled to the first opposite end portion of the first tube, wherein the second tube extends in the first axial direction away from the first opposite end portion along a second tube distance to a second opposite end portion; and a third tube having a third end portion coupled to the second opposite end portion of the second tube, wherein the third tube extends in the first axial direction away from the second opposite end portion along a third tube distance to a third opposite end portion, the third end portion of the third tube is axially offset from the first opposite end portion of the first tube in the first axial direction, and the first, second, and third tubes comprise different materials, coefficients of thermal expansion, Poisson's ratios, or elastic moduli, or a combination thereof; and reducing thermal stresses associated with the high intensity discharge via a wire coil extending through the composite leg about an electrode lead.

19. A method, comprising:

assembling a high intensity discharge lamp with a composite leg coupled to a central hollow body of an arc envelope, wherein the composite leg comprises an axially staggered tube assembly, comprising:

a first tube having a first end portion coupled to the central hollow body, wherein the first tube extends in a first axial direction away from the first end portion along a first tube distance to a first opposite end portion, and the first tube is made of a ceramic;

a second tube having a second end portion coupled to the first opposite end portion of the first tube, wherein the second tube extends in the first axial direction away from the first opposite end portion along a second tube distance to a second opposite end portion, and the second tube is made of molybdenum, or rhenium, or a molybdenum-rhenium alloy; and a third tube having a third end portion coupled to the second opposite end portion of the second tube, wherein the third tube extends in the first axial direction away from the second opposite end portion along a third tube distance to a third opposite end portion, and the third end portion of the third tube is axially offset from the first opposite end portion of the first tube in the first axial direction, wherein the third tube is made niobium;

compressing a the second tube about an electrode assembly extending through the composite leg; and focusing heat on the electrode assembly and the second tube to seal the second tube with the electrode assembly.

20. The system of claim 1, wherein the lead comprises a wire coil, and the wire coil comprises molybdenum, or rhenium, or molybdenum-rhenium alloy.

21. The system of claim 1, wherein the second tube comprises a molybdenum-rhenium alloy comprising about 44% to 48% by weight of rhenium.

22. The system of claim 9, wherein at least one of the first, second, or third tubes comprises molybdenum, or rhenium, or a molybdenum-rhenium alloy, wherein the first lead comprises molybdenum, or rhenium, or molybdenum-rhenium alloy.

23. The system of claim 9, wherein the first lead comprises a first wire coil made of molybdenum, rhenium, or a molybdenum-rhenium alloy, wherein one of the first, second, or third tubes is made of a metallic material compressed about the first wire coil.

24. The method of claim 17, wherein the first metal tube is made of the molybdenum-rhenium alloy with about 44% to 48% by weight of rhenium.

25. The method of claim 18, wherein the wire coil comprises molybdenum, or rhenium, or a molybdenum-rhenium alloy.

26. A system, comprising:

a high intensity discharge lamp, comprising:

a ceramic arc envelope comprising a first tube having a first end portion coupled to a central hollow body, wherein the first tube extends in a first axial direction away from the first end portion along a first tube distance to a first opposite end portion, the first tube and the central hollow body are a one-piece structure made of a ceramic, and the first tube has a diameter smaller than the central hollow body;

a second tube having a second end portion coupled to the first opposite end portion of the first tube in a first axially staggered configuration, wherein the second tube extends in the first axial direction away from the first opposite end portion along a second tube distance to a second opposite end portion, and the second tube is made of niobium, or molybdenum, or rhenium, or a molybdenum-rhenium alloy; and an electrode assembly comprising a lead extending through the first and second tubes.

27. The system of claim 26, comprising a third tube having a third end portion coupled to the second opposite end portion of the second tube in a second axially staggered configuration, wherein the third tube extends in the first axial direction away from the second opposite end portion along a third tube distance to a third opposite end portion.

28. The system of claim 27, wherein the lead comprises a wire coil disposed about a shaft, the first or second tube is secured to lead, and the lead is made of molybdenum, or rhenium, or a molybdenum-rhenium alloy.

* * * * *

UNITED STATES PATENT AND TRADEMARK OFFICE

CERTIFICATE OF CORRECTION

PATENT NO. : 8,053,990 B2
APPLICATION NO. : 11/858745
DATED : November 8, 2011
INVENTOR(S) : Bewlay et al.

It is certified that error appears in the above-identified patent and that said Letters Patent is hereby corrected as shown below:

In Column 15, Line 12, in Claim 19, delete "a the second" and insert -- the second --, therefor.

Signed and Sealed this
Twenty-ninth Day of May, 2012

David J. Kappos

David J. Kappos
*Director of the United States Patent and Trademark Office*